US006379523B1

(12) United States Patent
Takabayashi

(10) Patent No.: US 6,379,523 B1
(45) Date of Patent: Apr. 30, 2002

(54) METHOD OF TREATING SURFACE OF ALUMINUM BLANK

(75) Inventor: Masatomo Takabayashi, Nagano-ken (JP)

(73) Assignee: Izumi Techno Inc., Nagano-ken (JP)

( * ) Notice: Subject to any disclaimer, the term of this patent is extended or adjusted under 35 U.S.C. 154(b) by 0 days.

(21) Appl. No.: 09/486,966

(22) PCT Filed: Jul. 7, 1998

(86) PCT No.: PCT/JP98/03061

§ 371 Date: May 19, 2000

§ 102(e) Date: May 19, 2000

(87) PCT Pub. No.: WO00/01865

PCT Pub. Date: Jan. 13, 2000

(51) Int. Cl.[7] ..... C25D 11/20; C25D 11/04; C25D 11/08; C25D 11/06

(52) U.S. Cl. ..... 205/173; 205/324; 205/328; 205/329; 205/332; 205/202; 205/203; 205/224

(58) Field of Search ..... 205/173, 324, 205/328, 329, 332, 202, 203, 224

(56) References Cited

U.S. PATENT DOCUMENTS 3,562,121 A * 2/1971 Kape et al. ..... 204/58
5,935,656 A * 8/1999 Koerner et al. ..... 427/384

FOREIGN PATENT DOCUMENTS

| | | | |
|---|---|---|---|
| JP | 49-10121 | | 1/1974 |
| JP | 53-053533 A | * | 5/1978 |
| JP | 53-053533 A2 | * | 5/1978 |
| JP | 61-110797 | | 5/1986 |
| JP | 4-19455 | | 1/1992 |
| JP | 9-125284 | | 5/1997 |

OTHER PUBLICATIONS

*abstract only.*
*Abstract only.*

* cited by examiner

*Primary Examiner*—Edna Wong
(74) *Attorney, Agent, or Firm*—Burns, Doane, Swecker & Mathis, L.L.P.

(57) ABSTRACT

With the purpose of forming an anodic oxide coating that is given conductivity or other new functions on the surface of aluminum-based material with high productivity, anodizing of aluminum-based material (2) is performed in an anodizing bath containing sulfuric acid together with nitrate ion to form a porous anodic oxide coating on the surface of the aluminum-based material (2). In another processing step, if electroplating is performed after anodizing, silver or a silver compound or other metal (7) can be electroplated from an electroplating bath without dissolving and removing the barrier layer from the bottom (6) of the pores (3) of the porous anodic oxide coating (1).

7 Claims, 3 Drawing Sheets

METHOD OF TREATING SURFACE OF ALUMINUM BLANK

TECHNICAL FIELD

This invention relates to a surface treatment technique whereby metal is electroplated onto an anodic oxide coating formed on the surface of aluminum-based materials to give conductivity to said anodic oxide coating.

BACKGROUND ART

When aluminum-based materials consisting of aluminum or aluminum alloy are subjected to anodizing in a sulfuric acid bath or oxalic acid bath, as shown in FIG. 3(A), a porous anodic oxide coating 1 can be formed on its surface. Such an anodic oxide coating 1 has the function of increasing the weather resistance of aluminum-based materials 2, so this is used widely in a wide range of fields such as building materials and decorative products and the like.

In addition, as shown in FIG. 3(C), when metal 7 is electroplated onto the interior of the pore 3 of each cell 4, it is given conductivity so it can have new applications such as crack-resistant anti-static materials. However, a thick barrier layer 5 is formed in the bottom of the pores 3 in a porous anodic oxide coating 1 formed by conventional methods, so in order to electroplate metal 7 onto the interior of the pores 3 to give it conductivity, as shown in FIG. 3(*b*), it is necessary to remove the barrier layer 5 formed in the bottom of the pores 3 and then perform the electroplating process. In a conventional method used to remove this barrier layer 5, after anodizing is performed in a sulfuric acid bath or oxalic acid bath, the anodizing voltage in the same electrolyte bath or a different electrolyte bath is gradually lowered over a period of 15 to 20 minutes, thereby electrochemically dissolving the barrier layer 5 at the bottom of the pores 3 in the anodic oxide coating 1. In another method in use, after anodizing is performed in a sulfuric acid bath or oxalic acid bath, the power is turned off and the workpiece is left in the same electrolyte bath or a different electrolyte bath for a period of 15 to 30 minutes thereby chemically dissolving the barrier layer 5 at the bottom of the pores 3 in the anodic oxide coating 1. Moreover, both the latter method of dissolving the layer chemically and the former method of dissolving the layer electrochemically may also be used together to dissolve the barrier layer 5.

However, processing takes a long time in any of these conventional methods, so they have a problem in that their productivity is low. In addition, all of these processes require complicated and special techniques, so they have another problem in that their quality is unstable.

To this end, the object of this invention is to provide a surface treatment method whereby, without taking a long time in processing, an anodic oxide coating with no barrier layer or with a barrier layer so thin that it exhibits tunneling on the bottom of the pores is formed stably on the surface of aluminum-based materials and then metal is electroplated onto the interior of the pores in said anodic oxide coating to give said anodic oxide coating conductivity.

DISCLOSURE OF THE INVENTION

In order to achieve the above object, in the surface treatment method for aluminum-based materials according to the present invention, anodizing of an aluminum-based material consisting of aluminum or aluminum alloy is performed in an anodizing bath comprising nitrate ion together with at least one ion selected from among an organic acid ion or an inorganic acid ion able to form a porous anodic oxide coating, thereby forming a porous anodic oxide coating on the surface of said aluminum-based material, and then, electroplating of said aluminum-based material in performed in an electroplating bath comprising metal ion so that metal is electroplated from said electroplating bath into the pores in said porous anodic oxide coating, thereby giving said anodic oxide coating conductivity.

In the surface treatment method according to the present invention, the anodizing bath contains nitrate ion together with an organic acid ion or an inorganic acid ion able to form a porous anodic oxide coating, so by using this anodizing bath to perform the anodizing of the surface of aluminum-based materials, at the same time that the porous anodic oxide coating is being grown, the barrier layer is being dissolved at the bottom of the pores. For this reason, by the time that the anodizing process is complete, the barrier layer in the bottom of the pores in the porous anodic oxide coating is thin enough to exhibit tunneling or there is no barrier layer in the bottom of the pores. For this reason, even without performing current restoration or galvanic dissolution or other complicated barrier layer removal process in order to remove the barrier layer from the bottom of the pores in the porous anodic oxide coating, by simply performing the electroplating immediately it is possible to electroplate metal onto the interior of the pores in the anodic oxide coating to give the anodic oxide coating conductivity or other new functions.

In the present invention, as the aforementioned anodizing bath, it is possible to use a bath containing, for example, 100 g/l–300 g/l of sulfuric acid and 7 g/l–140 g/l of nitric acid or a nitrate. In addition, as the aforementioned anodizing bath, it is also possible to use a bath containing, for example, 100 g/l–300 g/l of sulfuric acid, 7 g/l–140 g/l of nitric acid and 10 g/l–100 g/l of a nitrate.

In the present invention, the anodizing is performed with the anodizing bath at a temperature of 0° C.–30° C. and at a current density of 0.5 $A/dm^2$–5.0 $A/dm^2$. Here, if the temperature of the anodizing bath is roughly 0° C.–30° C., the porous anodic oxide coating can be formed stably. In addition, if the temperature of the anodizing bath is roughly 0° C.–5° C., a hard porous anodic oxide coating can be formed.

In the present invention, it is preferable that an electroplating bath containing silver ion as the metal ion be used in the electroplating process, so that silver is electroplated into the pores of the porous anodic oxide coating. To this end, it is possible to use a bath containing, for example, 5 g/l–20 g/l of a silver salt and 10 g/l–20 g/l of a nitrate as the electroplating bath. With such a constitution, highly conductive silver will be electroplated into the pores of the anodic oxide coating, so an anodic oxide coating with a low surface resistance value can be formed. In addition, silver has antibacterial action, so it is possible to give the anodic oxide coating antibacterial properties.

In the present invention, the electroplating is performed with the electroplating bath at a temperature of 20° C.–30° C.

In the present invention, the surface resistance value of the anodic oxide coating can be controlled by the amount of silver electroplated into the pores of the porous anodic oxide coating.

In the present invention, after electroplating, the anodic oxide coating may be colored by electroplating additional metal within the pores of the anodic oxide coating. In addition, the anodic oxide coating may also be colored after electroplating by affixing organic dyes or organic pigments within the pores of the anodic oxide coating. With such a constitution, a design can be applied to the anodic oxide coating.

In the present invention, after the electroplating, it is preferable to seal the pores in the anodic oxide coating by performing water-vapor sealing, boiling-water sealing or low-temperature sealing. With such a constitution, it is possible to stabilize the metal or the like electroplated into the pores in the anodic oxide coating.

EXPLANATION OF SYMBOLS

Figure 1A:
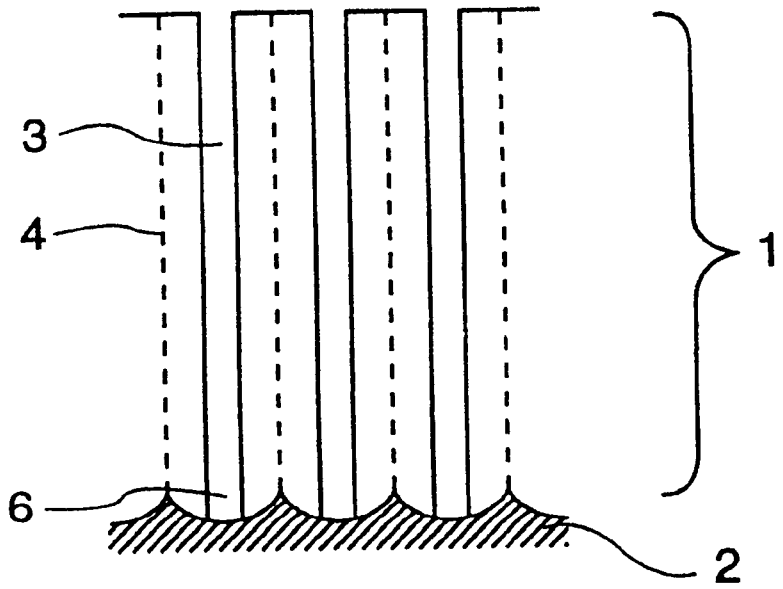
FIGS. 1(A) and (B) are both cross sections showing a step in the surface treatment method according to the present invention.
Figure 1B:
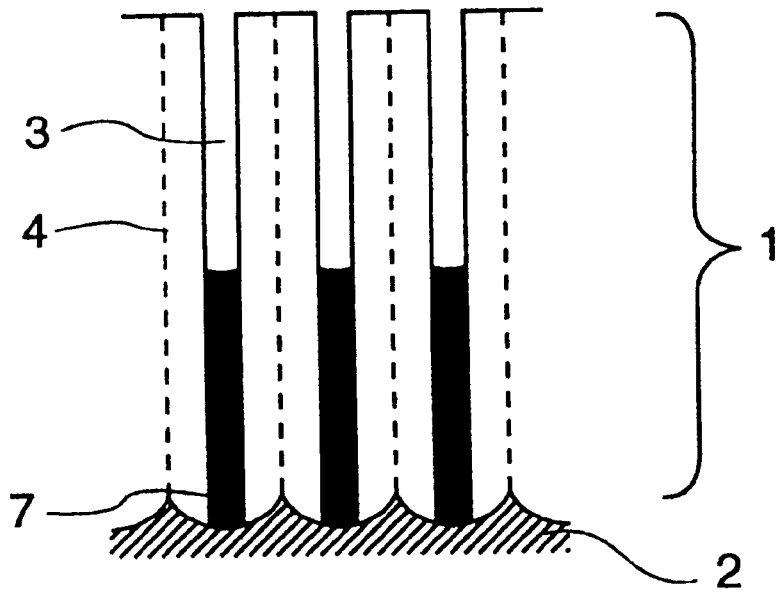

Porous anodic oxide coating
2 Aluminum-based material
3 Pore
4 Cell
5 Barrier layer
7 Metal

BEST MODE FOR CARRYING OUT THE INVENTION

Here follows an explanation of an embodiment of the present invention.

(Effect of the Amount of Nitric Acid Added to the Anodizing Bath on the Coating)

In carrying out the surface treatment method to which the present invention applies, aluminum-based material (grade: A5052P/aluminum-based material) with a thickness of 1 mm was immersed in an aqueous solution of 3 wt. % sodium hydroxide under conditions of a temperature of 40° C. for 30 seconds to perform degreasing. Next it was rinsed with deionized water. Next, the aluminum-based material was immersed in an aqueous solution of 10 wt.% nitric acid under conditions of a temperature of 15° C. for 30 seconds to perform neutralization. Next it was rinsed with deionized water.

Next, the aluminum-based material was subjected to anodizing under the conditions given in Table 1, to form a porous anodic oxide coating on the surface of the aluminum-based material.

TABLE 1

| Item | Samples | Amount of nitrate ion added (g/l) | Surface resistance value (MΩ) |
|---|---|---|---|
| Embodiment | Sample 1 | 21 | 133 |
| | Sample 2 | 42 | 125 |
| | sample 3 | 63 | 1.0 |
| | Sample 4 | 84 | 0.015 |
| | Sample 5 | 105 | 0.015 |
| | Sample 6 | 126 | 0.0125 |
| Comparative example | Sample A | 0 | Infinite |

The other conditions in this anodizing treatment were as follows:

| Composition of the anodizing bath | | |
|---|---|---|
| Sulfuric acid | 250 | g/l |
| Nitric acid | 0–126 | g/l |
| Dissolved aluminum | 3 | g/l |
| Deionized water | | Remainder |
| Anodizing bath temperature | 0° C. | |
| DC current density | 2.0 | A/dm$^2$ |
| Electrolysis time | 30 | minutes |

When anodizing of aluminum-based material was performed under these conditions, a porous anodic oxide coating 1 with a thickness of 35 μm was formed as shown in FIG. 1(A). Here, the anodizing bath contains nitrate ion together with sulfate ion which is able to form a porous anodic oxide coating 1, so by using this anodizing bath to perform the anodizing of the surface of the aluminum-based material 2, at the same time that the porous anodic oxide coating 1 is being grown, the barrier layer is being dissolved at the bottom 6 of the pores 3 of each cell 4. For this reason, by the time that the anodizing process is complete, the barrier layer in the bottom of the pores 3 in the porous anodic oxide coating 1 is thin enough to exhibit tunneling or there is no barrier layer.

The aluminum-based material 2 thus anodized was rinsed with deionized water and then electroplating was performed under the following conditions:

| Composition of the electroplating bath | | |
|---|---|---|
| Silver sulfate | 5 | g/l |
| Nitric acid | 10 | g/l |
| Deionized water | | Remainder |
| Voltage applied | 7.0 | V AC Voltage |
| Electrolysis time | 5 | minutes |
| Electroplating bath temperature | 20° C. | |

When electroplating is performed under these conditions, by the time that the anodizing is complete the barrier layer has already been removed from the bottom 6 of the pores 3 in the anodic oxide coating 1 as shown in FIG. 1(A), so by simply performing electroplating immediately, silver or a silver compound or other metal 7 is electroplated onto the interior of the pores 3 in the anodic oxide coating 1.

Then, the conductivity of the anodic oxide coating formed under the above conditions was measured. The measuring apparatus shown in FIGS. 2(A) and (B) was used for this measurement. In order to evaluate the surface resistance value of the anodic oxide coating using this measuring apparatus 10, first an electrode 11 for measuring resistance was placed upon the upper surface of a piece of aluminum-based material 2 measuring 50 mm×100 mm×1 mm (thick) which was subjected to anodizing and electroplating. This electrode 11 for measuring resistance consists of a glass plate 111 measuring 20 mm×20 mm×1 mm (thick) wrapped in aluminum foil 112 with a thickness of 15 μm. In this state, the electrode 11 for measuring resistance was pressed with a load of 3 kg against the aluminum-based material 2 which was subjected to anodizing and electroplating, and a DC power supply 13 applied a DC voltage of 20 V between the electrode 11 and the aluminum-based material 2 which was subjected to anodizing and electroplating. The resistance values found from the current flowing at this time are presented as the surface resistance values in Table 1.

As shown in Table 1, in the samples according to the embodiment of the present invention, as the amount of nitric acid added to the anodizing bath increases, the surface resistance value of the anodic oxide coating tended to drop to below 0.02 M. The reason for this is that as the amount of nitric acid added to the anodizing bath increases, the dissolution and removal of the barrier layer at the bottom of the pores in the anodic oxide coating is accelerated, resulting in the silver or silver compound being more easily electroplated onto the interior of the pores of the anodic oxide coating.

In contrast, in the sample subjected to anodizing in an anodizing bath that did not contain nitrate ions (the comparative example), there was a barrier layer at the bottom of the pores in the anodic oxide coating, so no silver or silver compound was electroplated, and thus a surface resistance value of infinite was indicated.

(Effect of the Current Waveform at the Time of Anodizing on the Coating)

In order to study the effect of the current waveform at the time of anodizing on the coating, as described above, aluminum-based material (grade: A5052P/aluminum-based material) with a thickness of 1 mm was subjected to degreasing with an aqueous solution of sodium hydroxide and acid cleaning with an aqueous solution of nitric acid, and then, as shown in Table 2, anodizing was performed using various current waveforms including DC waveforms, AC waveforms, waveforms consisting of DC superimposed on AC and pulse waveforms, to form a porous anodic oxide coating on the surface of the aluminum-based material.

TABLE 2

| Item Samples | | Power waveform | Coating thickness (μm) | Surface resistance (MΩ) |
|---|---|---|---|---|
| Embodiment | Sample 7 | DC | 15 | <0.01 |
| | Sample 9 | AC | 10 | 0.2–0.3 |
| | Sample 9 | Superimposed | 15 | <0.15 |
| | Sample 10 | Pulse | 15 | <0.18 |

When anodizing of aluminum-based material was performed under these conditions, a porous anodic oxide coating 1 with a thickness of 10 μm–15 μm was formed. Here, the anodizing bath contains nitrate ion, so dissolution of the barrier layer is proceeding at the bottom of the pores in the anodic oxide coating, and by the time that the anodizing process is complete, the barrier layer in the bottom of the pores in the porous anodic oxide coating is thin enough to exhibit tunneling or there is no barrier layer.

The aluminum-based material thus anodized was rinsed with deionized water and then electroplating was performed.

| Composition of the electroplating bath | |
|---|---|
| Silver sulfate | 5 g/l |
| Nitric acid | 10 g/l |
| Deionized water | Remainder |
| Voltage applied | 10 V AC voltage (0.8 A/dm$^2$) |
| Electrolysis time | 10 minutes |
| Bath temperature | 25° C. |

When electroplating is performed under these conditions, by the time that the anodizing is complete the barrier layer has already been removed from the bottom of the pores in the anodic oxide coating 1, so by simply performing electroplating immediately, metal is electroplated onto the interior of the pores in the anodic oxide coating.

Figure 2A:
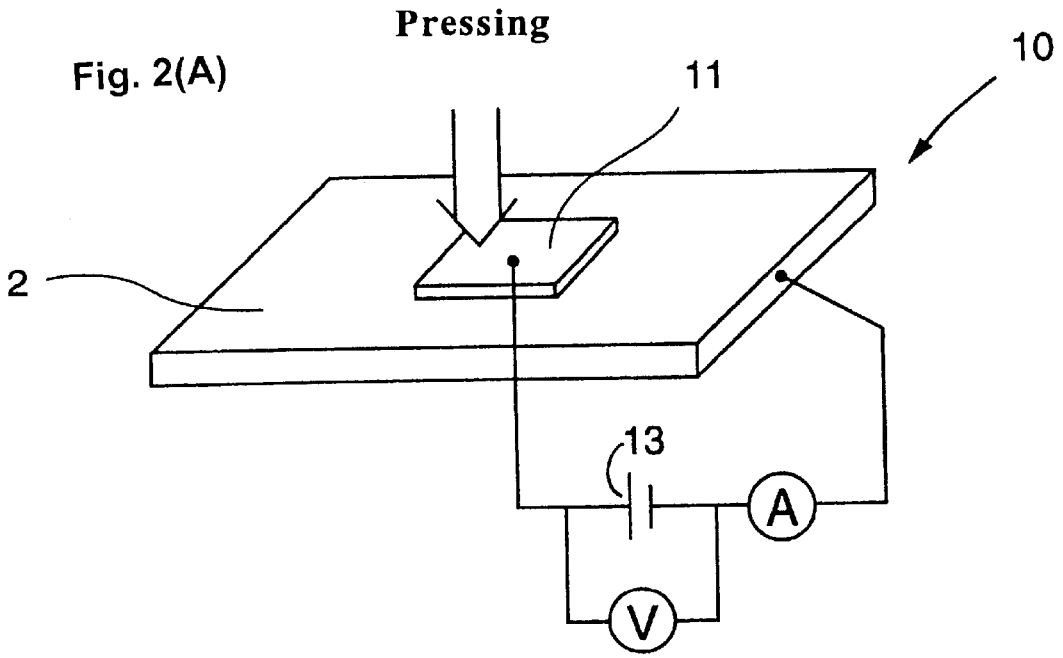
FIGS. 2(A) and (B) are both structural drawings of an apparatus used to measure the surface resistance value of the anodic oxide coating formed by means of the surface treatment method according to the present invention.
Figure 2B:
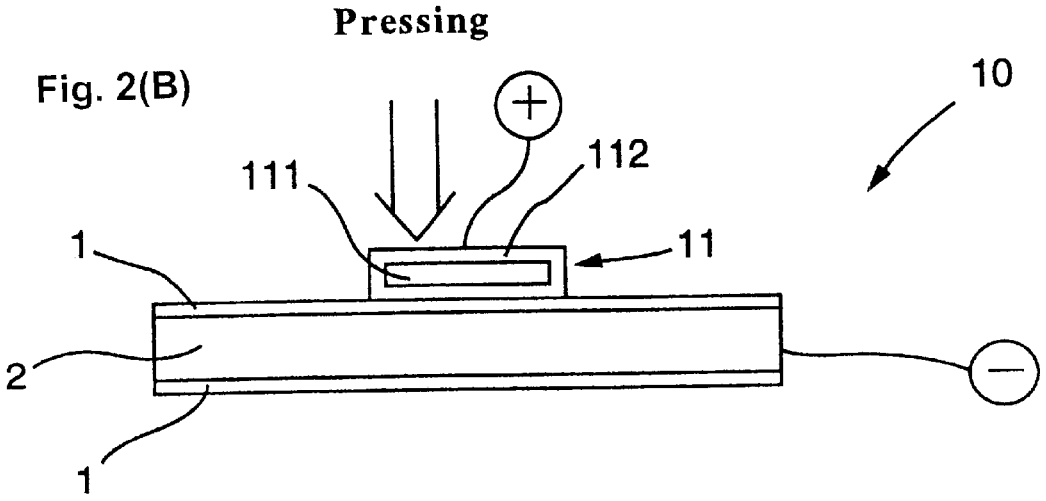
Figure 3A:
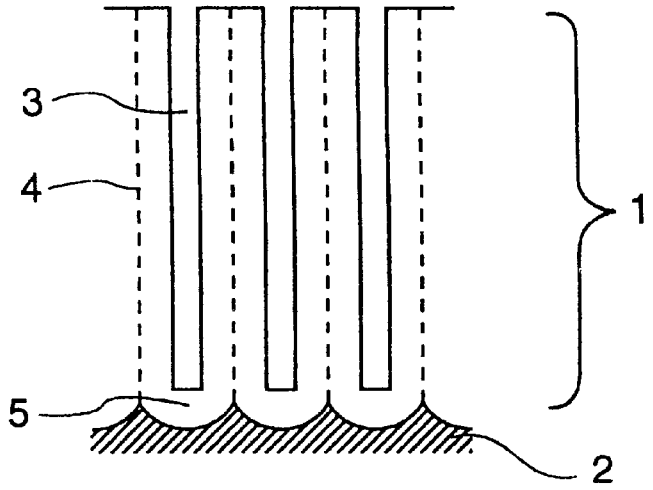
Fig. 3(A) PRIOR ART
FIGS. 3(A), (B) and (C) are all cross sections showing a step in the conventional surface treatment method.
Figure 3B:
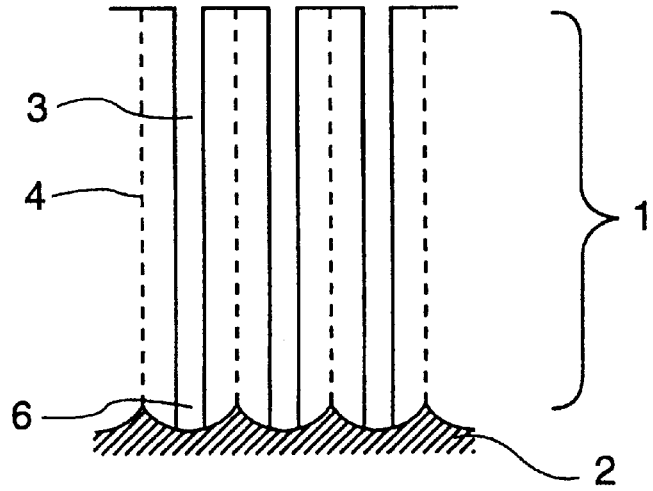
Fig. 3(B) PRIOR ART
Figure 3C:
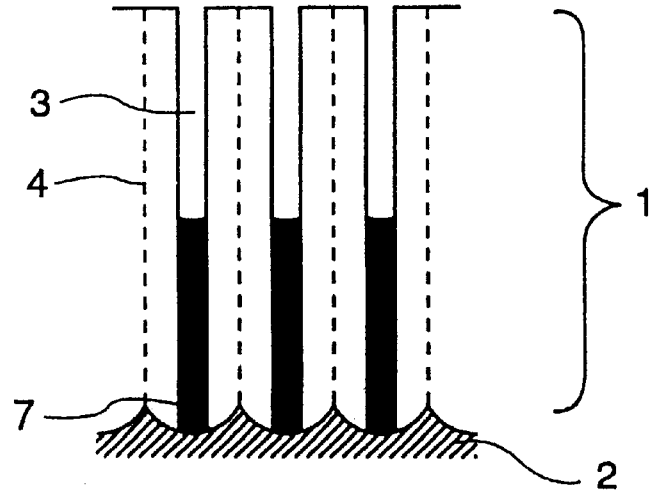
Fig. 3(C) PRIOR ART

Then, the surface resistance value of the anodic oxide coating formed under the above conditions was measured using the measuring apparatus described in reference to FIGS. 2(A) and (B), and the results of measurement are given in Table 2.

As shown in Table 2, it was confirmed that when any of DC, AC, a superimposed waveform of DC and AC, or a pulse waveform was used, silver or a silver compound was electroplated onto the interior of the pores of the anodic oxide coating, and the anodic oxide coating was given conductivity. In addition, the power waveform used at the time of performing anodizing is not limited to the aforementioned waveforms, but rather an imperfectly rectified waveform can also be used.

(Effect of the Silver Electroplating Time on the Coating)

In order to study the effect of the silver electroplating time on the coating, as described above, aluminum-based material (grade: A5052P/aluminum-based material) with a thickness of 1 mm was subjected to degreasing with an aqueous solution of sodium hydroxide and acid cleaning with an aqueous solution of nitric acid, and then, anodizing was performed under the following conditions to form a porous anodic oxide coating on the surface of the aluminum-based material.

| Composition of the anodizing bath | |
|---|---|
| Sulfuric acid | 250 g/l |
| Nitric acid | 70 g/l |
| Dissolved aluminum | 3 g/l |
| Deionized water | Remainder |
| Anodizing bath temperature | 20° C. |
| Current density | 1.5 A/dm$^2$ |
| Electrolysis time | 30 minutes |

When anodizing of aluminum-based material is performed under these conditions, the anodizing bath contains nitrate ion, so dissolution of the barrier layer is proceeding at the bottom of the pores in the anodic oxide coating, and by the time that the anodizing process is complete, the barrier layer in the bottom of the pores in the porous anodic oxide coating is thin enough to exhibit tunneling or there is no barrier layer.

The aluminum-based material thus anodized was rinsed with deionized water and then electroplating was performed under the conditions given in Table 3.

TABLE 3

| Item Samples | | Electroplating time (Minutes) | Surface resistance (MΩ) |
|---|---|---|---|
| Embodiment | Sample 11 | 2 | 120 |
| | Sample 12 | 4 | 80 |
| | Sample 13 | 6 | 1.2 |
| | Sample 14 | 8 | 0.01–0.03 |
| | Sample 15 | 10 | <0.01 |

| Composition of the electroplating bath | |
|---|---|
| Silver sulfate | 5 g/l |
| Nitric acid | 10 g/l |
| Deionized water | Remainder |
| Voltage applied | 10 V AC voltage (0.8 A/dm$^2$) |
| Electrolysis time | 2 minutes-10 minutes |
| Bath temperature | 25° C. |

When electroplating is performed under these conditions, metal is electroplated onto the interior of the pores in the anodic oxide coating.

Then, the surface resistance value of the anodic oxide coating formed under the above conditions was measured using the measuring apparatus described in reference to FIGS. 2(A) and (B), and the results of measurement are given in Table 3.

As shown in Table 3, it was confirmed that when the electroplating time was lengthened, the amount of silver or a silver compound electroplated onto the interior of the pores of the anodic oxide coating increased, and accordingly the surface resistance dropped. Therefore, the surface resistance of the anodic oxide coating can be controlled by the amount of silver electroplated onto the pores of the porous anodic oxide coating.

(Effect of the Anodizing Bath Composition on the Coating)

In order to study the effect of the anodizing bath composition on the coating, as described above, aluminum-based material (grade: A5052P/aluminum-based material) with a thickness of 1 mm was subjected to degreasing with an aqueous solution of sodium hydroxide and acid cleaning with an aqueous solution of nitric acid, and then, as shown in Table 4, anodizing was performed using an anodizing bath of various compositions wherein the amounts of magnesium nitrate and nitric acid added were varied, to form a porous anodic oxide coating on the surface of the aluminum-based material.

TABLE 2

| Item | Samples | Anodizing bath composition Sulfuric acid 200 g/l: Magnesium nitrate (g/l) | Nitric acid (g/l) | Surface resistance (MΩ) |
|---|---|---|---|---|
| Embodiment | Sample 16 | 10 | 0 | 0.3 |
| | Sample 17 | 20 | 0 | 0.1 |
| | Sample 18 | 30 | 0 | 0.05 |
| | Sample 19 | 30 | 42 | <0.01 |
| | Sample 20 | 30 | 84 | <0.01 |

| Composition of the anodizing bath | |
|---|---|
| Sulfuric acid | 200 g/l |
| Nitric acid | 0–84 g/l |
| Magnesium nitrate | 10–30 g/l |
| Dissolved aluminum | 3 g/l |
| Deionized water | Remainder |
| Anodizing bath temperature | 20° C. |
| Current density | 1.5 A/dm$^2$ |

When anodizing of aluminum-based material was performed under these conditions a porous anodic oxide coating 1 with a thickness of 15 $\mu$m was formed. Here, the anodizing bath contains nitrate ion, so dissolution of the barrier layer is proceeding at the bottom of the pores in the anodic oxide coating, and by the time that the anodizing process is complete, the barrier layer in the bottom of the pores in the porous anodic oxide coating is thin enough to exhibit tunneling or there is no barrier layer.

The aluminum-based material thus anodized was rinsed with deionized water and then electroplating was performed. The conditions for this electroplating were as follows:

| Composition of the electroplating bath | |
|---|---|
| Silver sulfate | 5 g/l |
| Nitric acid | 10 g/l |
| Deionized water | Remainder |
| Voltage applied | 10 V AC voltage (0.8 A/dm$^2$) |
| Electrolysis time | 10 minutes |
| Bath temperature | 25° C. |

When electroplating is performed under these conditions, metal is electroplated onto the interior of the pores in the anodic oxide coating.

Then, the surface resistance value of the anodic oxide coating formed under the above conditions was measured using the measuring apparatus described in reference to FIGS. 2(A) and (B), and the results of measurement are given in Table 4.

As shown in Table 4, it was confirmed that when the amount of magnesium nitrate (a nitrate) and nitric acid added increased, the surface resistance value of the anodic oxide coating tended to decrease. The reason for this is that as the amount of nitrate ion added to the anodizing bath increases, the dissolution and removal of the barrier layer at the bottom of the pores in the anodic oxide coating is accelerated, resulting in the silver or silver compound being more easily electroplated onto the interior of the pores of the anodic oxide coating.

Other Embodiments

Note that while the above embodiments are examples wherein nitrate ion is added to an anodizing bath containing sulfate ion as the ion able to form a porous anodic oxide coating, examples of other ions able to form a porous anodic oxide coating include not only sulfate ion and other inorganic ions, but also oxalate ion and other organic ions, and these ions may be included in an anodizing bath to which is added nitrate ion, and this bath may be used.

In addition, the metal that is electroplated onto the interior of the pores in the anodic oxide coating by electroplating is not limited to silver, but cobalt, nickel, tin or other metals may also be electroplated. Moreover, after silver or other metal is electroplated onto the interior of the pores in the anodic oxide coating by electroplating, cobalt, nickel, tin or other metals may also be additionally electroplated thereupon in order to color the anodic oxide coating. In addition, the anodic oxide coating may also be colored after electroplating by affixing organic dyes or organic pigments or other known organic colorants within the pores in the anodic oxide coating. With ouch a constitution, a design can be applied to the anodic oxide coating.

Furthermore, the aluminum-based material subjected to the surface treatment according to the present invention may be subjected to water-vapor sealing wherein it is exposed to water vapor; the aluminum-based material subjected to the surface treatment according to the present invention may be subjected to boiling-water sealing wherein it is immersed in boiling deionized water or nickel acetate at a temperature of roughly 80° C.; or the aluminum-based material subjected to the surface treatment according to the present invention may be subjected to low-temperature sealing wherein it is immersed in an aqueous solution of nickel fluoride at a temperature of roughly 40° C., thereby preferably sealing the pores of the anodic oxide coating. With such a constitution, it is possible to stabilize the metal or the like electroplated into the pores in the anodic oxide coating.

Industrial Applicability

As explained in the foregoing, according to the present invention, nitrate ion is added to an anodizing bath containing sulfuric acid and the like, so when aluminum-based material is anodized, an anodic oxide coating with the barrier layer removed from the bottom of the pores can be produced. Therefore, it is possible to electroplate silver or other metal upon the inside of the pores in the anodic oxide coating without performing complex and time-consuming operations to remove the barrier layer from the bottom of the pores in the anodic oxide coating. For this reason, it is possible to use electroplated metal to form anodic oxide coatings with new functions such as conductivity or wear resistance on the surface of aluminum-based materials with good productivity. Thus, since the anodic oxide coating upon which metal is deposited is conductive, the aluminum-based material upon which this anodic oxide coating is formed can be have electrostatic functions and can be used for crack-resistant jig and tool components for semiconductor manufacture, computer-related components, electronic components and the like. In addition, since a hard anodic oxide coating electroplated with metal has sliding properties, lubricant properties, wear resistance and heat resistance, it is possible to manufacture bearing members, rotary sliding components, sliders, pistons and the like from aluminum-based materials upon which this anodic oxide coating is formed.

In addition, since an anodic oxide coating with silver or a silver compound electroplated thereupon has antibacterial properties, various types of antibacterial products can be manufactured from aluminum-based materials upon which this anodic oxide coating is formed.

What is claimed is:

1. A surface treatment method for aluminum-based materials comprising the steps of:

anodizing an aluminum-based material consisting of aluminum or aluminum alloy in an anodizing bath comprising an amount of nitrate ion together with at least one ion selected from among an organic acid ion or an inorganic acid ion able to form a porous anodic oxide coating, thereby forming a porous anodic oxide coating on the surface of said aluminum-based material, controlling the amount of the nitrate ion in the anodizing bath to form a desired thickness of a barrier layer portion defining a bottom of each pore of the porous anodic oxide coating; and then, electroplating said aluminum-based material in an electroplating bath comprising metal ion so that metal is electroplated from said electroplating bath into the pores in said porous anodic oxide coating, thereby giving said anodic oxide coating conductivity;

wherein said anodizing bath comprises 100–300 g/l of sulfuric acid and 60–140 g/l of nitric acid, and 10–100 g/l of a nitrate.

2. The surface treatment method according to claim 1, wherein the metal ion in the electroplating bath comprises a silver ion.

3. The surface treatment method according to claim 1, wherein after said electroplating, a different metal is affixed within the pores in said anodic oxide coating to color said anodic oxide coating.

4. The surface treatment method according to claim 1, wherein after said electroplating, an organic colorant is affixed within the pores in the anodic oxide coating to color said anodic oxide coating.

5. The surface treatment method according to claim 1, wherein after said electroplating, water vapor sealing is performed to seal the pores in the anodic oxide coating.

6. The surface treatment method according to claim 1, wherein after said electroplating, boiling water sealing is performed to seal the pores in the anodic oxide coating.

7. The surface treatment method according to claim 1, wherein after said electroplating, low temperature sealing is performed to seal the pores in the anodic oxide coating.

* * * * *